US005187416A

United States Patent [19]

Bazin

[11] Patent Number: 5,187,416

[45] Date of Patent: Feb. 16, 1993

[54] ARC DISCHARGE LAMP WITH A VERTICAL THERMAL SWITCH EXTENDING BETWEEN THE LAMP STEM AND INNER NECK WALL

[75] Inventor: Simone P. Bazin, Bedford, N.H.

[73] Assignee: GTE Products Corporation, Danvers, Mass.

[21] Appl. No.: 808,995

[22] Filed: Dec. 17, 1991

[51] Int. Cl.[5] ..... H01J 7/44; H01J 17/34

[52] U.S. Cl. ..... 315/73; 313/25; 313/595; 315/47; 315/60

[58] Field of Search ..... 315/73, 60, 100, 47; 313/25, 595

[56] References Cited

U.S. PATENT DOCUMENTS 3,619,710 11/1971 Waymouth ..... 315/73
3,965,387 6/1976 Stuart et al. ..... 315/47
4,659,965 4/1987 Bonazoli ..... 315/60
5,015,916 5/1991 Mazza et al. ..... 315/47

*Primary Examiner*—Robert J. Pascal
*Assistant Examiner*—Michael B. Shingleton
*Attorney, Agent, or Firm*—Joseph S. Romanow

[57] ABSTRACT

An arc discharge lamp having an arc tube mounted within a lamp envelope includes a thermal switch for controlling application of electrical energy to a starting electrode. The thermal switch is mounted between the arc tube and the lamp base with its longitudinal axis generally parallel to the central axis of the lamp envelope. The thermal switch is spaced from the central axis of the lamp envelope by a support rod and extends into an annular space between the lamp stem and the wall of the lamp envelope. As a result, the maximum temperature of the thermal switch during lamp operation does not exceed about 400° C.

11 Claims, 2 Drawing Sheets

ARC DISCHARGE LAMP WITH A VERTICAL THERMAL SWITCH EXTENDING BETWEEN THE LAMP STEM AND INNER NECK WALL

FIELD OF THE INVENTION

This invention relates to arc discharge lamps which utilize a thermal switch to control application of electrical energy to a starting electrode and, more particularly, to arc discharge lamps having a thermal switch mounted in a relatively cool part of the lamp and mounted to facilitate lamp assembly.

BACKGROUND OF THE INVENTION

Metal halide arc discharge lamps are widely used for general illumination. These lamps include an arc tube mounted within a light-transmissive lamp envelope. The lamp envelope may be evacuated or backfilled with nitrogen. The arc tube has electrodes mounted at opposite ends and contains a fill material including a starting gas, mercury and one or more metal halides. A starting electrode is typically mounted at one end of the arc tube adjacent to one of the main electrodes to assist in starting. When the lamp is first turned on, a voltage is applied between the starting electrode and the adjacent main electrode. A discharge between the starting electrode and the adjacent main electrode heats the arc tube sufficiently to form a discharge between the main electrodes. After a discharge is formed between the main electrodes, the starting electrode is shorted to the adjacent main electrode by a thermal switch.

A thermal switch for metal halide lamps is disclosed in U.S. Pat. No. 3,965,387, issued Jun. 22, 1976 to Stuart et al. The disclosed thermal switch includes a bimetal element and a conductive spring element attached to the bimetal element. At temperatures above the closure temperature of the thermal switch, the spring element is deformed, thereby relieving some of the stress which would otherwise be applied to the bimetal element.

A thermal switch for an arc discharge lamp is disclosed in U.S. Pat. No. 4,659,965, issued Apr. 21, 1987 to Bonazoli. The disclosed switch includes a bimetal strip attached to one electrode lead and a spring-like member attached to another electrode lead. The bimetal strip has a notch to receive the spring-like member when the closure temperature is reached.

A thermal switch wherein a bimetal element moves with a sliding action along a resilient conductor as the temperature increases above the closure temperature so as to minimize stress and provide a self-cleaning action is disclosed in pending application Ser. No. 07/634,464, filed Dec. 27, 1990.

While prior art thermal switches provide generally satisfactory operation, certain practical problems have arisen in the use of thermal switches in compact, low wattage arc discharge lamps. In prior art lamps, the bimetal element is typically mounted laterally with respect to the longitudinal axis of the lamp envelope. In compact arc discharge lamps with a lamp envelope having a small diameter neck, the bimetal element interferes with installation of the arc tube assembly in the lamp envelope. Furthermore, the bimetal element may be damaged by the relatively high temperatures in compact arc discharge lamps.

One solution to this problem is disclosed in U.S. Pat. No. 5,015,916, issued May 14, 1991 to Mazza et al. The bimetal element is bent to avoid interference with the lamp envelope without shortening of the bimetal element However, the disclosed configuration may create undesired sets in the bimetal element and weaken the resilient conductor, and adds angles that must be controlled in production. In addition, it is believed that the thermal switch is subjected to excessive temperatures during operation in compact arc discharge lamps. When the thermal switch is repeatedly subjected to excessive temperatures, the closure temperature may be changed, or the thermal switch may fail to operate entirely.

It is a general object of the present invention to provide improved arc discharge lamps.

It is another object of the present invention to provide arc discharge lamps with improved mounting arrangements for thermal switches.

It is a further object of the present invention to provide arc discharge lamps wherein a thermal switch is mounted in a relatively cool location within the lamp envelope.

It is yet another object of the present invention to provide arc discharge lamps wherein a thermal switch is mounted to facilitate lamp assembly.

It is a further object of the present invention to provide arc discharge lamps wherein a thermal switch is mounted to avoid extreme operating temperatures.

It is still another object of the present invention to provide arc discharge lamps having a thermal switch mounting arrangement that is low in cost and easy to manufacture.

SUMMARY OF THE INVENTION

According to the present invention, these and other objects and advantages are achieved in an arc discharge lamp comprising a light-transmissive lamp envelope, an arc tube mounted within the lamp envelope, the arc tube including first and second main electrodes and a starting electrode, means for conducting electrical energy to the main electrodes, a thermal switch having a longitudinal axis, and means for mounting the thermal switch with its longitudinal axis generally parallel to the central axis of the lamp envelope. The thermal switch electrically connects the starting electrode to the first main electrode at and above a predetermined temperature. The thermal switch includes a bimetal element having first and second ends, and a resilient conductor attached to the bimetal element. The thermal switch is mounted in a relatively cool location selected to avoid thermal damage during lamp operation.

The means for mounting the thermal switch preferably includes a support rod attached to an electrode lead of the first main electrode. The bimetal element is attached at or near its first end to the support rod. In a preferred embodiment, the support rod is generally perpendicular to the central axis of the lamp envelope such that the thermal switch is spaced from the central axis. The thermal switch is preferably positioned by the support rod between the arc tube and the lamp base. The thermal switch preferably extends into an annular space between the lamp stem and the wall of the lamp envelope.

By mounting the thermal switch between the arc tube and the lamp base in generally parallel alignment with the central axis of the lamp envelope, the maximum temperature of the thermal switch is limited to an acceptable level. In addition, an arc tube assembly carrying the thermal switch is easily installed in the lamp envelope.

BRIEF DESCRIPTION OF THE DRAWINGS

For a better understanding of the present invention, together with other and further objects, advantages and capabilities thereof, reference is made to the accompanying drawings which are incorporated herein by reference and in which.

DETAILED DESCRIPTION OF THE INVENTION

Figure 1:
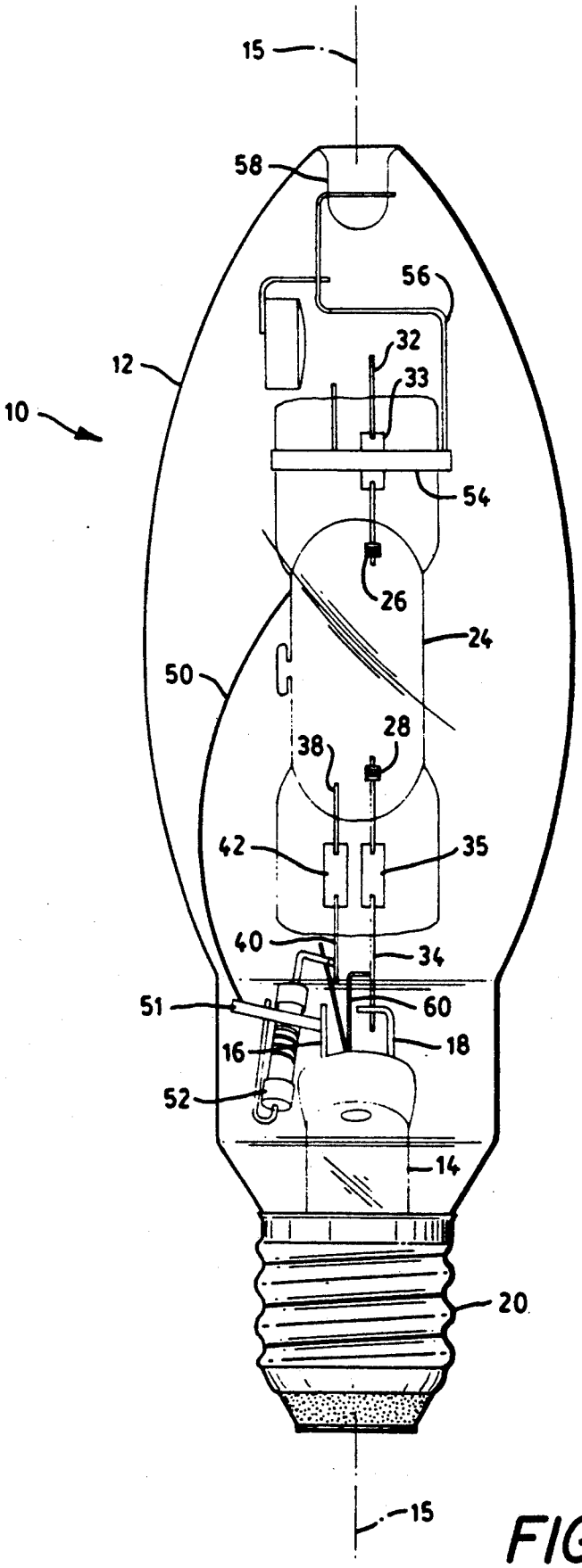
FIG. 1 is an elevation view of an arc discharge lamp in accordance with the present invention.

A metal halide arc discharge lamp 10 in accordance with the present invention is shown in FIG. 1. A lamp envelope 12 is hermetically sealed to a lamp stem 14. The lamp envelope 12 has a central axis 15. Electrical inleads 16 and 18 are sealed into and pass through lamp stem 14, and are electrically connected to a lamp base 20.

Mounted within the lamp envelope 12 is an arc tube 24. The arc tube 24 has main electrodes 26 and 28 mounted in opposite ends thereof. Electrode 26 is electrically connected to an electrode lead 32 by a molybdenum foil conductor 33. Electrode 28 is electrically connected to an electrode lead 34 by a molybdenum foil conductor 35. A starting electrode 38 is mounted in arc tube 24 adjacent to main electrode 28. The starting electrode 38 is electrically connected to a starting electrode lead 40 by a molybdenum foil conductor 42. The molybdenum foil conductors 33, 35 and 42 are sealed into arc tube 24 using a press seal construction, as known in the art.

The electrode lead 34 is connected to electrical inlead 18 through a nickel hook (not shown). A conducting wire 50 is connected from electrode lead 32 to a nickel hook 51. The nickel hook 51 is connected to electrical inlead 16. Thus, electrical inleads 16 and 18 are electrically connected to electrodes 26 and 28, respectively. A resistor 52 is connected between nickel hook 51 and starting electrode lead 40.

A strap 54 encircles and is securely attached to the upper end of arc tube 24. The strap 54 is affixed to a frame member 56, which extends upwardly and engages an inward projection 58 in the dome end of lamp envelope 12. The arc tube 24 is mechanically supported within lamp envelope 12 by electrode lead 34 and frame member 56.

Figure 2:
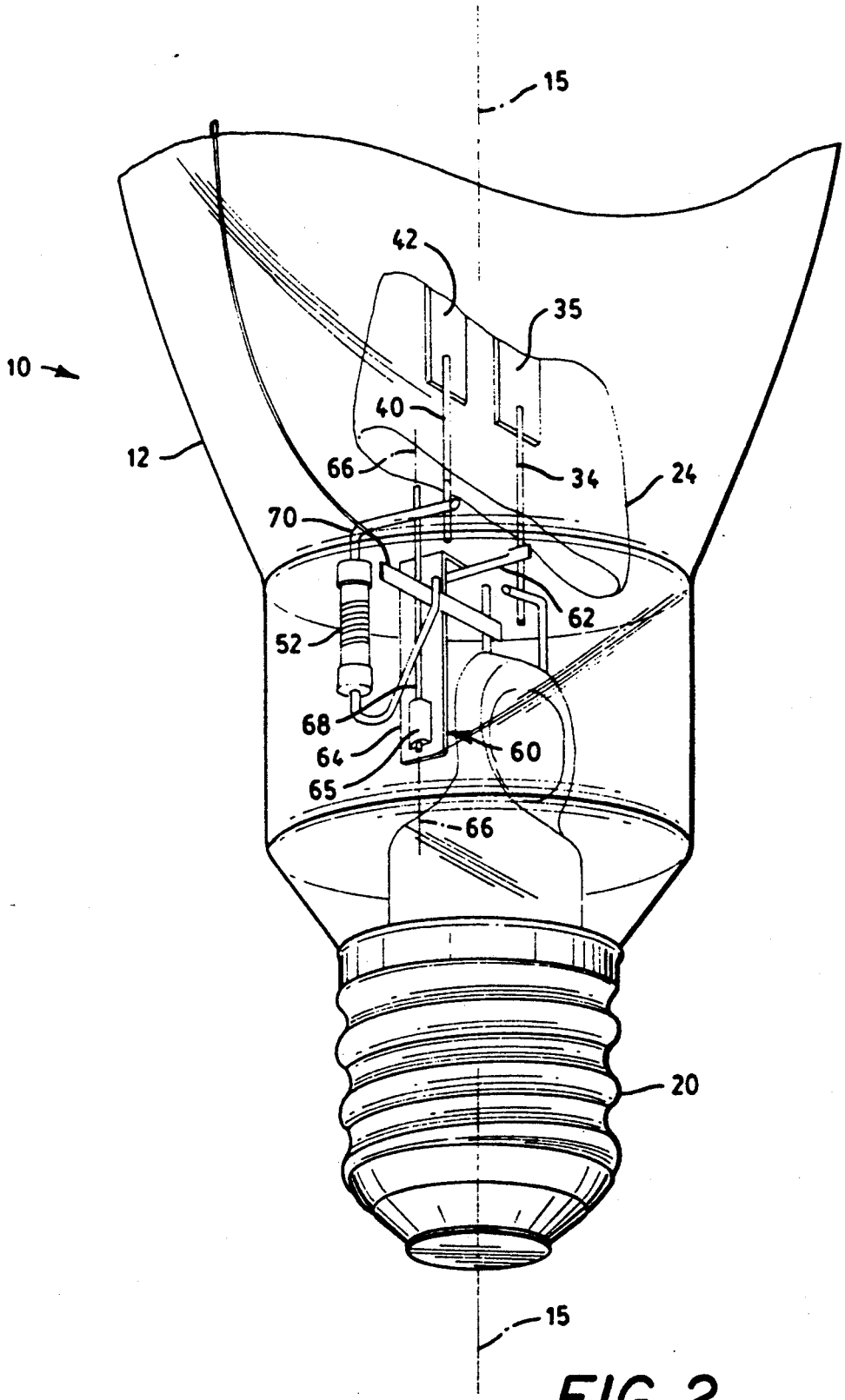
FIG. 2 is an enlarged perspective view of the neck portion of the lamp of FIG. 1 showing one end of the arc tube and the thermal switch extending into the annular space between the lamp stem and inner wall of the lamp neck.

A thermal switch 60 is mounted by a support rod 62 to electrode lead 34. The thermal switch 60 includes an elongated bimetal element 64 and a resilient, elongated conductor 68. The thermal switch 60 has a longitudinal axis 66. A first end of bimetal element 64 includes a bend for mounting to support rod 62, typically by welding. The conductor 68 is attached to a second end of bimetal element 64. As best shown in FIG. 2, a portion 65 of the bimetal element 64 is pushed out, and the conductor 68 is inserted through portion 65. Then, the conductor 68 is crimped and welded to the bimetal element 64. The support rod 62 is preferably mounted generally perpendicular to the central axis 15 of lamp envelope 12, and is preferably welded to electrode lead 34. In a preferred embodiment, the support rod 62 is nickel having a diameter of 0.040 inch. The length of support rod 62 depends on the size of the lamp. In a 175 watt metal halide arc lamp, the support rod 62 preferably has a length of 9 millimeters.

The thermal switch 60 is preferably mounted to support rod 62 such that its longitudinal axis 66 is generally parallel to the central axis 15 of lamp envelope 12. The support rod 62 spaces the thermal switch 60 from the central axis 15 of lamp envelope 12. As best shown in FIG. 1, the thermal switch 60 is located between arc tube 24 and lamp base 20, and extends at least partially into an annular space between lamp stem 14 and the wall of lamp envelope 12. Thus, the thermal switch 60 is located in a neck region of the lamp envelope 12. In the neck region between the arc tube 24 and the lamp base 20, the maximum temperature is substantially lower than the maximum temperature in the region adjacent to the arc tube 24.

A resistor lead 70 of resistor 52 is attached to starting electrode lead 40. The resistor lead 70 is preferably mounted approximately parallel to support rod 62. When power is applied to lamp 10, the thermal switch 60 is at room temperature, and conductor 68 is spaced from resistor lead 70. Thus, the starting electrode 38 is connected through resistor 52 to electrical inlead 16, and the lamp voltage is initially applied between starting electrode 38 and main electrode 28. This causes a discharge to be formed between starting electrode 38 and main electrode 28, causing the arc tube 24 to gradually increase in temperature. When the arc tube 24 is sufficiently heated, an arc discharge is established between main electrodes 26 and 28. During heating of arc tube 24, the thermal switch 60 is heated, and the bimetal element 64 is deformed. The deformation of bimetal element 64 causes the conductor 68 to move toward resistor lead 70. At a predetermined closure temperature, conductor 68 contacts resistor lead 70 and electrically short circuits starting electrode 38 and main electrode 28. The starting electrode 38 is thereafter inoperative during normal operation of lamp 10. The predetermined closure temperature of the thermal switch 60 is selected such that starting electrode 38 is shorted to main electrode 28 after formation of a discharge between main electrodes 26 and 28.

In a specific example of the invention, the arc tube 24 comprises a quartz metal halide arc tube containing iodides of mercury, scandium, sodium and cesium, and mercury metal, plus argon rare gas fill at a nominal pressure of 45 torr. The electrodes 26 and 28 include thoriated tungsten electrode rods and tungsten coils. The electrode leads 32, 34 and 40 are molybdenum rods. The lamp envelope 12 is commonly known in the industry as a type ED17 for its elliptical shape, projection 84 in the dome end and a major outside diameter of 1 $\frac{7}{8}$ inches. The lamp has a rating of 175 watts. The bimetal element 64 is a type E5 Truflex and is 4 millimeters wide by 12 millimeters long, with a structural bend at one end for mounting to support rod 62. The flexible conductor 68 is preferably tungsten wire having a diameter of 0.010 inch and is welded to the bimetal element 64.

Initially, it was not thought possible to mount the thermal switch 60 in the annular space between the lamp stem 14 and the wall of lamp envelope 12 because of the heat involved in sealing the lamp stem 14 to lamp envelope 12. However, over 100 lamp envelopes have been sealed without destroying a thermal switch. In addition, 10 lamps in accordance with the invention have been operated over 3000 hours without failure of the thermal switch. In the example described above, the maximum temperature of the thermal switch 60 is limited to about 328° C. during operation. It is desirable to limit the maximum temperature of the thermal switch during lamp operation to about 400° C.

A first approach in the development of the present invention was to mount the thermal switch with its longitudinal axis generally parallel to the central axis of the lamp envelope and extending upwardly toward the dome end of the lamp envelope. In this configuration, the lower end of the thermal switch was approximately adjacent to the lower end of the arc tube. This placed the thermal switch in close proximity to the arc tube. In this configuration, the weld between the bimetal element and the flexible conductor separated after 2000 hours. The failure was believed to be caused by excessive operating temperature at the weld between the bimetal element and the flexible conductor.

A summary of test results is given in Table I below. Table I lists the type of lamp tested, the operating temperature of the thermal switch and the test results. The first two entries in Table I show results for prior art 1000 watt lamps and 400 watt lamps, respectively. The third entry in Table I shows the results for a 175 watt lamp with the thermal switch mounted axially and in close proximity to the arc tube as described above. The fourth entry shows the results for a 175 watt lamp with the thermal switch mounted in accordance with the present invention. It is noted that the thermal switch remains at a temperature of about 328° C. during operation in accordance with the present invention.

TABLE I

| Description | Temperature | Status |
|---|---|---|
| 1000 W Lamp | 500° C. | 2 of 8 Failures at 12,000 hours |
| 400 W Lamp | 383° C. | Normally operated 20,000+ hours without failure |
| 175 W Lamp-Bimetal near arc tube | 430° C. | 2 of 5 Failed at weld at 2,000 hours |
| 175 W Lamp-Bimetal near lamp stem | 328° C. | 0 of 10 Failed >3,000 hours |

By mounting the thermal switch 60 generally parallel to the central axis 15 of the lamp envelope 12 in accordance with the present invention, the arc tube assembly with thermal switch 60 attached is easily installed in lamp envelope 12. It is not necessary to shorten the bimetal element 64 or to form additional bends in the bimetal element. Furthermore, the thermal switch 60 is located in a region of the lamp where the maximum temperature does not cause damage to the bimetal element. Although the present invention is most advantageous in compact arc discharge lamps of small size and high operating temperatures, the invention can be utilized in any size arc discharge lamp.

While there have been shown and described what are at present considered the preferred embodiments of the present invention, it will be obvious to those skilled in the art that various changes and modifications may be made therein without departing from the scope of the invention as defined by the appended claims.

What is claimed is:

1. An arc discharge lamp comprising:

a light-transmissive lamp envelope having a central axis and a neck, said lamp envelope having a stem extending into said neck;

an arc tube mounted within said lamp envelope, said arc tube including first and second main electrodes and a starting electrode;

means including a lamp base for conducting electrical energy to said main electrodes;

a thermal switch having a longitudinal axis; and means for mounting said thermal switch within said neck of said lamp envelope with said longitudinal axis of said thermal switch generally parallel to the central axis of said lamp envelope such that said thermal switch extends into the annular space between said lamp stem and a wall of said lamp envelope, said thermal switch electrically connecting said starting electrode to said first main electrode at and above a predetermined temperature.

2. An arc discharge lamp as defined in claim 1 wherein said thermal switch includes a bimetal element having a first end, a second end, and a resilient conductor attached to said bimetal element at or near said second end thereof.

3. An arc discharge lamp as defined in claim 2 wherein said means for mounting said thermal switch includes a support rod attached to an electrode lead of said first main electrode and said bimetal element is attached to said support rod at or near said first end of said bimetal element.

4. An arc discharge lamp as defined in claim 3 wherein said support rod is generally perpendicular to said central axis of said lamp envelope.

5. An arc discharge lamp as defined in claim 4 further including a resistor electrically connected between said starting electrode and said second main electrode, said resistor having a lead attached to an electrode lead of said starting electrode, said thermal switch being positioned such that said resilient conductor contacts said resistor lead at and above said predetermined temperature.

6. An arc discharge lamp as defined in claim 2 wherein said means for mounting said thermal switch includes a support rod attached between said bimetal element and an electrode lead of said first main electrode, for spacing said thermal switch from said electrode lead.

7. An arc discharge lamp as defined in claim 2 wherein said resilient conductor comprises a tungsten wire.

8. A metal halide arc discharge lamp comprising:

a light-transmissive lamp envelope having a central axis and a neck, said lamp envelope having a stem extending into said neck;

a metal halide arc tube mounted within said lamp envelope, said arc tube including first and second main electrodes and a starting electrode;

a lamp base attached to said lamp envelope;

electrical leads extending from said lamp base through said lamp stem to said first and second main electrodes;

a thermal switch having a longitudinal axis and including a bimetal element having first and second ends, and a resilient conductor attached to said bimetal element at or near the second end thereof; and means for mounting said thermal switch within said neck of said lamp envelope with the longitudinal axis of said thermal switch generally parallel to the central axis of said lamp envelope such that said thermal switch extends into the annular space between said lamp stem and a wall of said lamp envelope, said thermal switch electrically connecting said starting electrode to said first main electrode at and above a predetermined temperature.

9. A metal halide arc discharge lamp as defined in claim 8 wherein said means for mounting said thermal switch includes a support rod attached to the electrode lead of said first main electrode and said bimetal element is attached to said support rod at or near said first end of said bimetal element.

10. A metal halide arc discharge lamp as defined in claim 9 wherein said thermal switch is spaced by said support rod from said central axis of said lamp envelope.

11. A metal halide arc discharge lamp as defined in claim 8 wherein said thermal switch is mounted such that its maximum temperature during operation of said lamp does not exceed about 400° C.

* * * * *